US005355205A

United States Patent [19]

Toyama et al.

[11] Patent Number: 5,355,205

[45] Date of Patent: Oct. 11, 1994

[54] IMAGE FORMING METHOD AND APPARATUS HAVING IMPROVED COPY SHEET SUPPLY INLET SELECTABILITY

[75] Inventors: Osamu Toyama, Kobe; Kadotaro Nishimori, Himeji, both of Japan

[73] Assignee: Minolta Camera Kabushiki Kaisha, Osaka, Japan

[21] Appl. No.: 17,136

[22] Filed: Feb. 12, 1993

[30] Foreign Application Priority Data

Feb. 17, 1992 [JP] Japan ..... 4-029514

[51] Int. Cl.[5] ..... G03G 15/00; G03G 21/00; B65H 3/44; B65H 5/26

[52] U.S. Cl. ..... 355/311; 271/9

[58] Field of Search ..... 355/308, 309, 311; 271/9

[56] References Cited

U.S. PATENT DOCUMENTS

| | | | |
|---|---|---|---|
| 4,763,889 | 8/1988 | Dei et al. | 355/311 X |
| 4,881,104 | 11/1989 | Kusumoto et al. | 355/309 |
| 5,075,786 | 12/1991 | Ikenoue et al. | 355/311 X |
| 5,105,230 | 4/1992 | Emori | 355/308 X |
| 5,153,641 | 10/1992 | Takahashi | 355/309 X |
| 5,172,178 | 12/1992 | Oushiden et al. | 355/311 |

*Primary Examiner*—Fred L. Braun

*Attorney, Agent, or Firm*—Willian Brinks Hofer Gilson & Lione

[57] ABSTRACT

An image forming apparatus provided with a plurality of sheet supply inlets respectively accommodating different kinds of sheets and a selecting member for selecting a desired kind of sheets. When a desired kind of sheets is selected by the selecting member, a check is made to determine whether the presently selected sheets are the same kind, for example, the same size, as the sheets which have been selected prior to the operation of the selecting member. When the presently selected sheets are the same kind as the sheets selected prior to the operation of the selecting member, the apparatus is controlled so that a sheet supply inlet accommodating the same kind of sheets as the sheet selected prior to operation of the selecting member but different from the sheet supply inlet used for sheet supply prior to the operation of the selecting member, for example, a sheet supply inlet in which the same kind of sheets are oriented in a different direction, is selected. The invention provides an image forming apparatus with improved operational efficiency.

8 Claims, 7 Drawing Sheets

IMAGE FORMING METHOD AND APPARATUS HAVING IMPROVED COPY SHEET SUPPLY INLET SELECTABILITY

BACKGROUND OF THE INVENTION

1. Field of the Invention

The present invention relates to an image forming apparatus capable of performing an image forming operation using copy sheets selectively chosen from among copy sheets of different sizes or types accommodated in a plurality of paper inlets.

2. Description of the Related Art

In copying apparatus capable of selecting a desired paper from among papers accommodated within a plurality of paper inlets, paper selection heretofore has been accomplished by the conventional methods described below. One such method is the so-called direct selection wherein selection keys are provided not just for each paper size, but also for each paper type (e.g., vertical and horizontal paper feed directions) of each paper size, and paper selection is accomplished by directly depressing a selection key for a desired type of the desired paper. Another such method is the so-called rotation selection method wherein a single selection key is provided for all paper types and a single selection key is provided for all paper sizes, and paper selection is accomplished by repeatedly depressing the selection key so as to sequentially change the paper size and type.

Direct selection has advantages from an operational standpoint insofar as it allows a desired paper to be directly selected from among papers of all sizes and all types. However, the direct selection method has disadvantages inasmuch as the operation panel becomes more complex as the number of selection keys increases due to the addition of keys for selecting paper type which includes not only paper feed direction, but also paper quality, color and the like.

Rotation selection has the advantage of allowing a simple operation panel, but is disadvantageous in that it requires that the selection key be depressed many times to select a desired paper. A further disadvantage is a loss of operational efficiency as the number of paper size and type selections increase.

Accordingly, whatever paper selection method is used in recent copying apparatus providing a broad range of paper selections, the disadvantages remain rather prominent in spite of the aforesaid advantages.

The previously described problems are not limited only to paper selection, but are also prevalent in magnification selection and the like.

SUMMARY OF THE INVENTION

A main object of the present invention is to provide an image forming apparatus having excellent operational efficiency.

Another object of the present invention is to provide an image forming apparatus with an operation panel requiring a minimum number of selection keys.

Still another object of the present invention is to provide an image forming apparatus with excellent paper inlet selectability.

The aforesaid objects of the present invention are accomplished by providing an image forming apparatus as described below.

An image forming apparatus comprising:

a plurality of sheet supply inlets respectively accommodating different kinds of sheets:

selecting means for selecting a desired kind of sheets:

determining means for determining whether the presently selected sheets are the same kind as the sheets which have been selected prior to operation of the selecting means: and control means for controlling so that the sheet supply inlet accommodating the same kind of sheets as the sheet selected prior to operation of the selecting means but different from the sheet supply inlet used for sheet supply prior to operation of the selecting means is selected when the presently selected sheets are the same kind as the sheets which have been selected prior to the operation of the selecting means.

The aforesaid objects of the present invention are further achieved by providing an image forming apparatus described below.

An image forming apparatus which is operated in one of a plurality of first categories for image forming and one of a plurality of second categories each of which further classifies each of the first categories, said image forming apparatus comprising:

selecting means for selecting one desired first category; and control means for controlling said selecting means so as to select one desired second category following the selection of the desired first category.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE PREFERRED EMBODIMENT

A preferred embodiment of the present invention is described hereinafter with reference to the accompanying drawings.

(a) Copying Apparatus Construction

Figure 1:
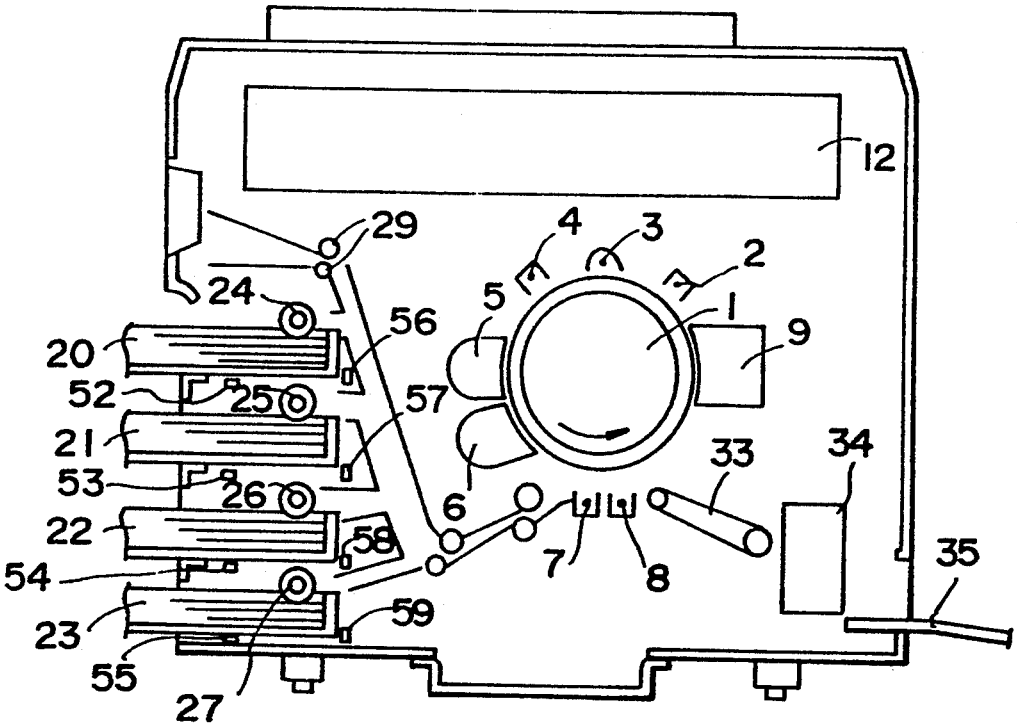
FIG. 1 is a brief section view of the copying apparatus of the present invention.

A brief section view of the copying apparatus of the present invention is shown in FIG. 1.

In the central portion of the copying apparatus is provided a photosensitive drum 1 which is rotatably driven in a counterclockwise direction. Arranged sequentially around the periphery of the photosensitive drum 1 are a subcharger 2, eraser lamp 3, main charger 4, top developing device 5, bottom developing device 6, transfer charger 7, transfer sheet separation charger 8, cleaning device 9 of the blade type and the like. The photosensitive drum 1 is once charged by the subcharger 2, thereafter irradiated by light from the eraser lamp 3, and charged by the main charger 4, whereupon the photosensitive drum 1 receives image exposure from the optical system 12.

An electrostatic latent image is formed on the surface of the photosensitive drum 1 by means of the aforesaid image exposure. This electrostatic latent image is then developed by the developing device 5 or 6 to produce a color (i.e., red or blue) toner image or a black toner image.

At the left side of the copying apparatus in the drawing, paper cassettes accommodating paper of various sizes and types are arranged at four levels of paper inlets 20, 21, 22, and 23. The paper loaded into the paper inlets 20, 21, 22, and 23 is selectively fed into the copying apparatus by means of their respective paper feed rollers 24, 25, 26 and 27. Furthermore, paper may also be fed from the manual feed paper inlet via a pair of feed rollers 29. Fed paper sheets adhere to the surface of the photosensitive drum 1 in the transfer portion, the toner image is transferred from the surface of the photosensitive drum 1 onto the sheet via the transfer charger 7, then the sheet is separated from the surface of the photosensitive drum 1 by means of the separation charger 8. The paper sheet is then transported in a rightward direction in conjunction with the rotation of the suction type transport belt 33, the toner image is fused onto the sheet by passing the fixing device 34, and the sheet is finally deposited on the discharge tray 35.

The switches 52, 53, 54, and 55 are microswitches for detecting the size and type (i.e., vertical and horizontal paper feed directions, in the present embodiment) of paper loaded in the paper inlets 20, 21, 22 and 23. The switches 56, 57, 58, and 59 are microswitches for detecting the loading and unloading of cassettes in the paper inlets 20, 21, 22 and 23.

(b) Operation Panel

Figure 2:
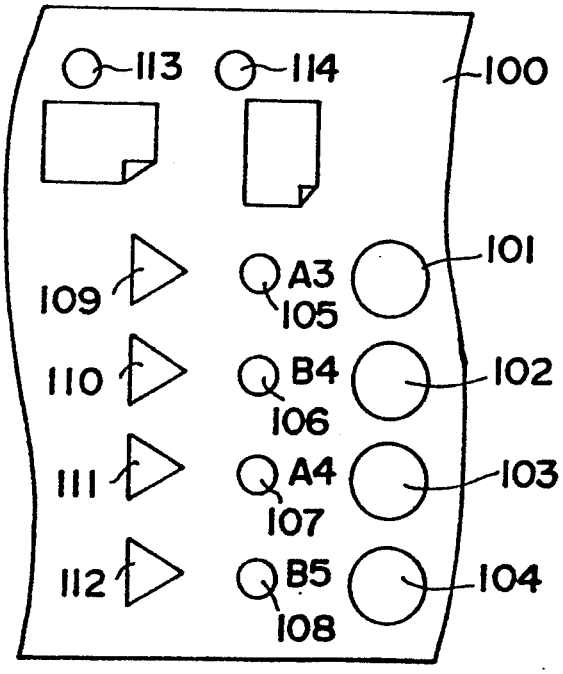
FIG. 2 is an illustration of the paper selection portion of the control panel provided on the top of the copying apparatus of the present invention.

FIG. 2 shows the paper selection portion of the operation panel provided on the top of the copying apparatus. The construction of the operation panel other than the paper selection portion, e.g., the construction of various selection keys relating to various types of processing such as setting the number of copy sheets, setting magnification and the like, is commonly known and is, therefore, omitted from the present description.

Paper size selection keys 101~104 are provided on the right side of the paper selection portion of the operation panel, and are sequentially arranged from the top as A3 (key 101), B4 (key 102), A4 (key 103), and B5 (key 104). The LEDs 105~108 are arranged on the left side of the aforesaid paper selection keys 101~104, and indicate the cassettes accommodating the respective sizes of paper are loaded. The LEDs 109~112 are arranged on the left side of the aforesaid LEDs 105~108, and indicate the selection of the current size paper relative to the aforesaid paper selection keys 101~104 and LEDs 105~108. Above the LEDs 105~112 are provided the LEDs 113 and 114 for indicating whether the paper feed direction of the currently selected paper is the vertical feed direction or the horizontal feed direction, and beneath each of said LEDs 113 and 114 is provided a graphic icon describing each of said feed direction.

In the copying apparatus of the present invention, the presence of the paper currently accommodated in the loaded cassettes is indicated by the lighting of the LEDs 105~108 corresponding to the size of said paper. When an operator directly selects a desired paper size by depressing a selection key of said desired size among the paper size selection keys 101~104, the LED corresponding to said desired size is lighted among the LEDs 109~112, and one among of the paper feed direction indicating LEDs 113 and 114 is lighted. At this time, if both vertical feed and horizontal feed direction oriented paper of identical size are loaded, the paper feed direction is selectable by rotation of the paper feed directions by repeatedly depressing the paper size selection key.

(c) Copying Apparatus Operation <c−1> Main Routine

Figure 3:
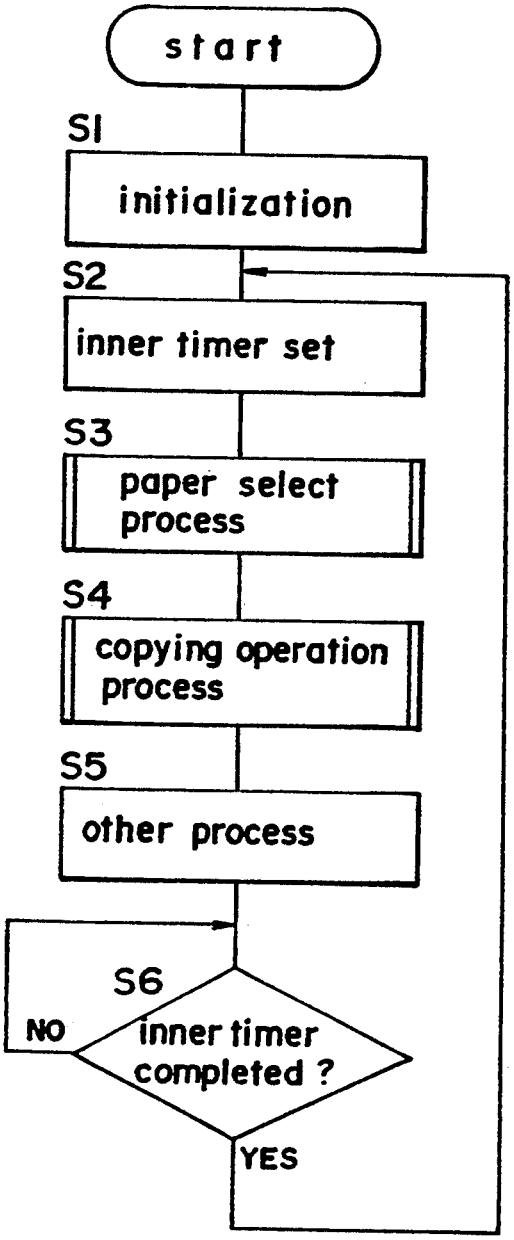
FIG. 3 is a flow chart showing the main routine describing the copy operation of the copying apparatus of the present invention.

The processing sequences of the copy operation are hereinafter described in conjunction with the accompanying flow charts. FIG. 3 briefly shows the main routine.

First, in step S1, the microcomputer is reset, then the initialization process is executed to preset specific data for variable components of the copying apparatus, e.g., number of copies=1, copy magnification=equal magnification, paper supply section=uppermost level and the like. Then, in step S2, an inner timer is set to determine the length of one routine, and the routine advances to step S3. In step S3, a subroutine is called and executed for the paper select process. The paper select subroutine is described in detail later. In step S4, the copy operation process is executed to control the copy operation which is a commonly known process. Other processes are executed in step S5. In step S6, the completion of the inner timer set in step S2 is awaited, and the completion of said inner timer determines the end of one routine, whereupon the routine returns to step S2.

The following description pertains only to details of the paper select process related to the present invention in the aforesaid step S3. Descriptions of the other processes are omitted.

<c−2> Paper selection routine

Figure 4:
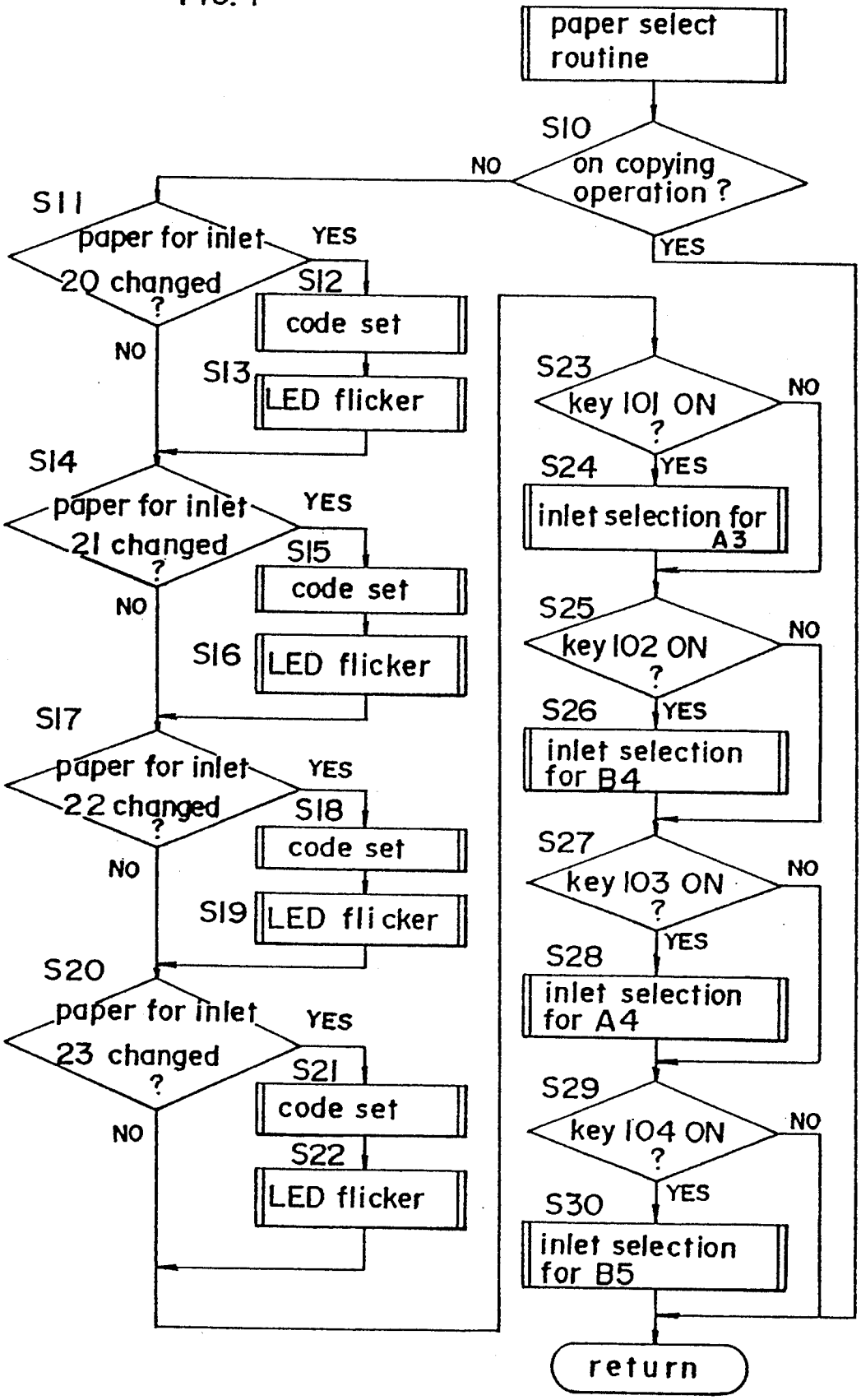
FIG. 4 is a flow chart describing the paper selection routine within the main routine.

FIG. 4 is a flow chart showing the paper selection routine of step S3. The copying apparatus of the present embodiment is provided with four levels of paper inlets into which are loadable four types of paper, including paper size and paper feed direction. Therefore, in the paper selection routine the specific paper sizes and specific paper inlets relative thereto are expressed by unique 16-bit code. As shown in Table 1, paper inlet 20 is specified by $S_0$, paper inlet 21 is specified by $S_1$, paper inlet 22 is specified by $S_2$, and paper inlet 23 is specified by $S_3$. Also in the Table, A3 paper size is specified by S1, B4 paper size is specified by S2, A4 paper size is specified by S3, and B5 paper size is specified by S4. The combination of the aforesaid two sets of designations specifies the paper size and paper inlet, e.g., A3 size paper at paper inlet 20 is specified by the code $S1_0$. (For convenience, the 4-bit codes comprising $Sn_3$, $Sn_2$, $Sn_1$, and $Sn_0$ are referred to as "size codes" hereinafter.)

A unique code distinct from the aforesaid size code is provided in order to express the paper feed direction of the paper loaded in the aforesaid paper inlets 20, 21, 22, and 23. As shown in Table 2, the paper feed direction of the paper inlet 20 is specified by $T_0$, the direction of paper inlet 21 is specified by $T_1$, the direction of paper inlet 22 is specified by $T_2$, and the direction of paper inlet 23 is specified by $T_3$. (These codes are referred to as "direction codes" hereinafter).

In FIG. 4, a determination is first made as to whether or not the copying apparatus is currently executing a copy operation (step S10). If a copy operation is currently executing, this routine ends.

If a copy operation is not currently ongoing, a check is then made to determine whether or not the paper loaded in the paper inlet 20 has changed (step S11). That is, a check is made to determine whether or not the paper cassette has been removed and reinstalled to add paper, change paper size and the like. If some change has occurred relative to the accommodated paper, the bit contents are updated for the size code and direction code relative to the paper inlet 20 (step S12), and the corresponding LED flicker controls are executed (step S13). That is, the relevant LED among the LEDs 105~108 is lighted relative to the size of the paper loaded in the paper inlet 20. If no change has occurred relative to the paper of inlet 20, the routine directly continues. Identical processes are executed in steps S14 through S22 for the paper inlets 21, 22, and 23. Thereafter, the routine continues to determine whether or not one among the paper size selection keys 101~104 has been depressed.

First, a check is made to determine whether or not the A3 selection key 101 has been depressed (step S23). If the A3 selection key 101 has been depressed, the paper inlet currently accommodating A3 size paper is selected (step S24) in the A3 selection routine of the paper inlet selection routine described later, and the routine continues. If the A3 selection key 101 has not been depressed, the routine directly continues. In steps S25 through S30, identical processes are sequentially executed for paper sizes B4, A4, and BS, and the paper selection routine ends.

The bit setting routine, LED flicker control routine, and paper inlet selection routine executed within the aforesaid paper selection routine are described hereinafter.

<c−3> Code Setting Routine

Figure 5:
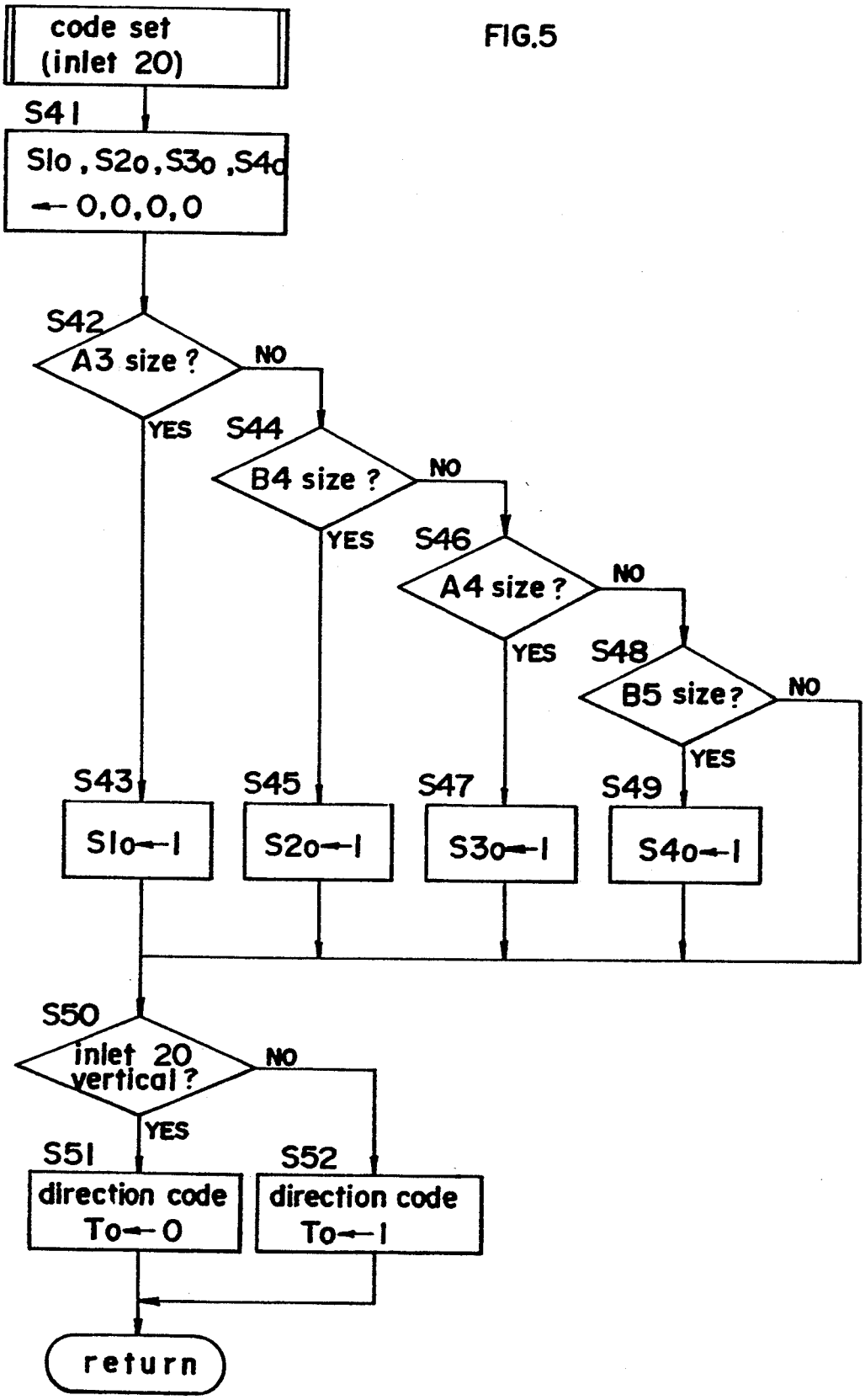
FIG. 5 is a flow chart describing the code setting routine within the paper selection routine.

FIG. 5 shows the code setting routine using the paper inlet 20 as an example. In this routine, the 4-bit codes, among the previously mentioned 16-bit codes, are set for each paper inlet to specify the size of the paper loaded in each paper inlet, and the direction code bits are set for each paper inlet to specify whether or not the paper loaded at each paper inlet is oriented vertically or horizontally for feeding.

First, the bits $S1_0$, $S2_0$, $S3_0$, and $S4_0$, which express the various paper size codes for paper inlet 20, are all assigned 0 (zero) (step S41). Then, a check is made to determine whether or not the paper loaded in paper inlet 20 is A3 size (step S42). This determination is accomplished by means of the detection signal generated by the previously mentioned switch 52. If the paper is determined to be A3 size, the $S1_0$ bit is assigned 1 (step S43), and the routine continues to the direction code generation. If the paper is not A3 size, a check is made to determine whether or not the paper loaded in inlet 20 is B4 size (step S44). Similar determinations are sequentially made for A4 and B5 sizes in steps S46 through S49. When the size of the paper currently loaded in paper inlet 20 is determined, the routine continues to the direction code generation.

In direction code generation, a check is made to determine whether or not the paper loaded in the inlet 20 is loaded vertically by means of the detection signal of the switch 52 (step S50). If the paper is loaded vertically, the bit $T_0$ expressing paper inlet 20 is assigned 0 (step 51), and this routine ends. If, however, the paper is loaded horizontally, the bit $T_0$ is assigned 1 (step S52), and this routine ends.

Although the above description used the paper inlet 20 as an example, the same flow chart may likewise pertain to the paper inlets 21, 22, and 23.

<c−4> LED Flicker Control (paper presence indicating)

Figure 6:
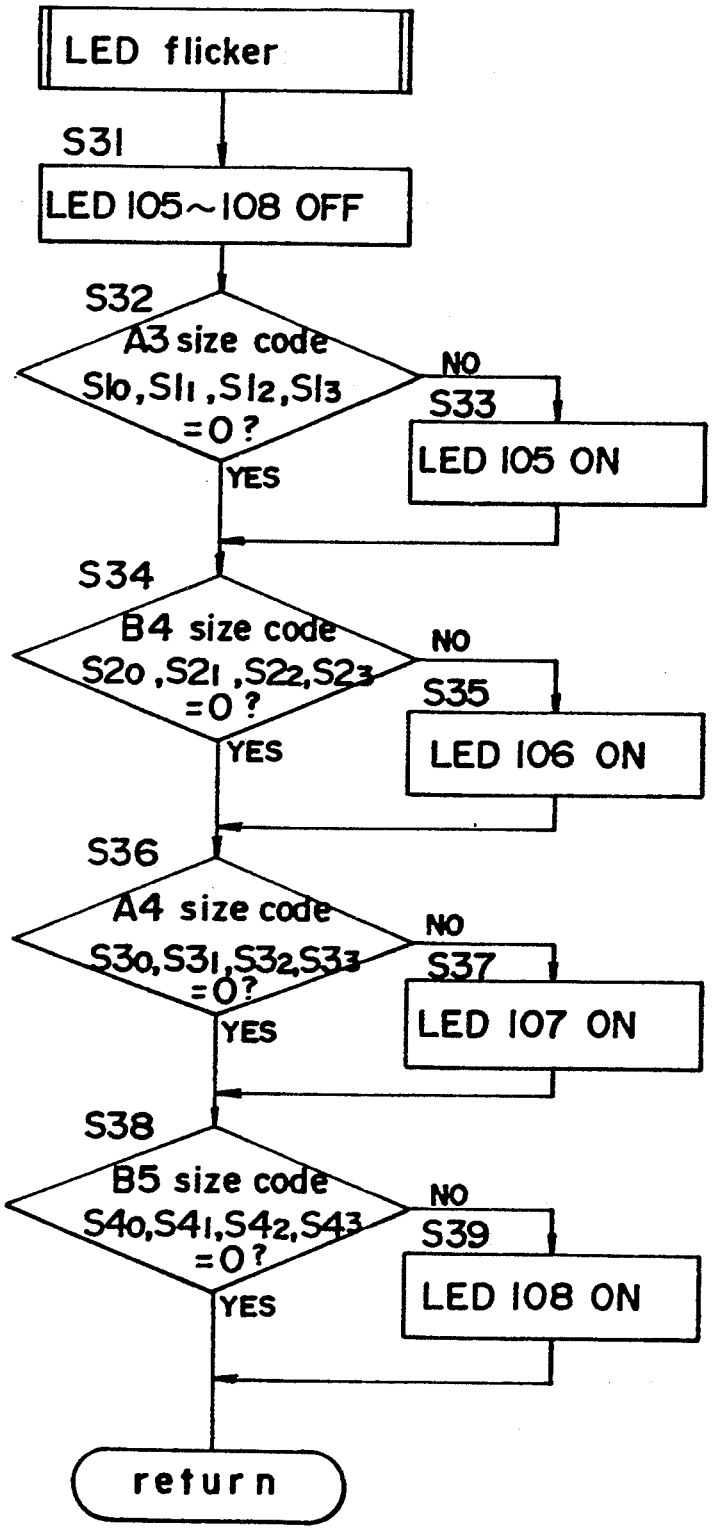
FIG. 6 is a flow chart showing the LED flicker control routine within the paper selection routine.

The LED flicker control routine for lighting the LEDs 105 through 108 is described hereinafter with reference to FIG. 6.

First, all LEDS 105~108 are extinguished (step S31), then a check is made to determine whether or not A3 size paper is accommodated in any of the paper inlets 20 through 23 using the A3 size code (step S32). That is, a check is made to determine whether or not all the paper size code bits $S1_0$, $S2_0$, $S3_0$, or $S4_0$ are set at 0 (zero). If even one A3 size paper is present, the LED 105 is lighted and the routine advances (step S33), whereas if A3 size paper is not present, the routine directly advances. Then, similar determinations are made sequentially for paper sizes B4, A4, and B5 in steps S34 and S35, then this routine ends.

<c−5> Paper (inlet) Selection

Figure 8:
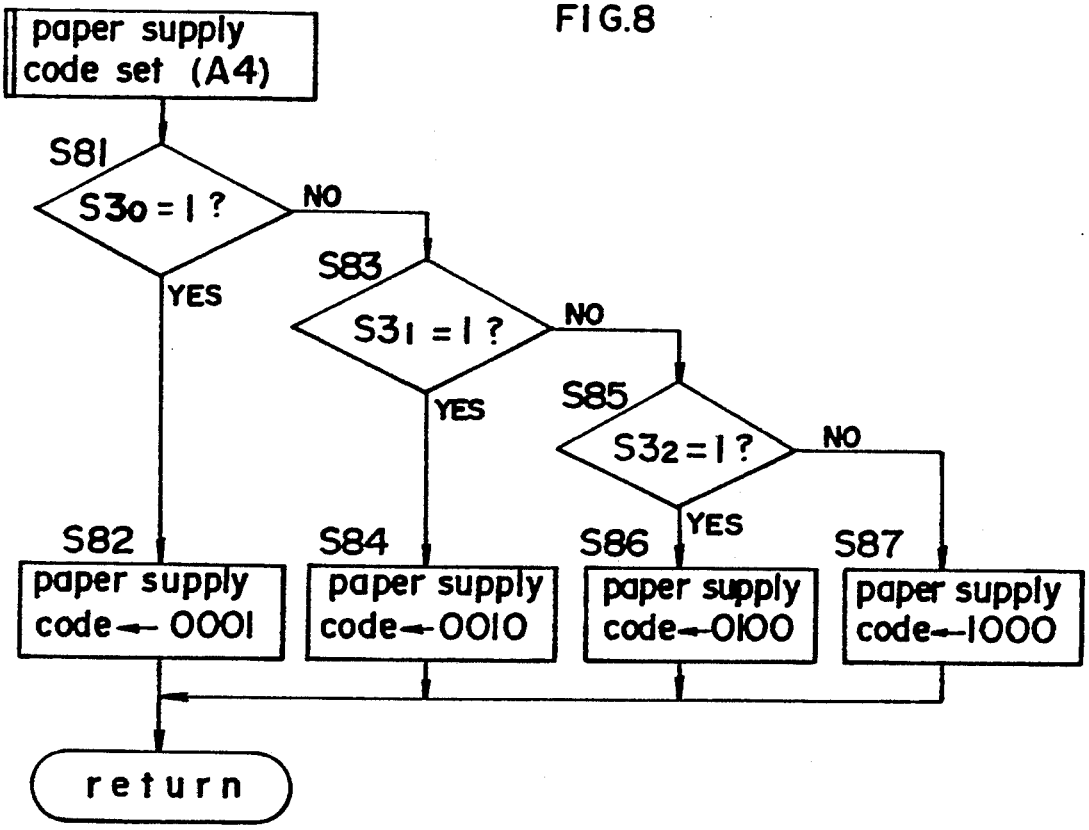
FIG. 8 is a flow chart showing the paper supply code set routine within the paper inlet select routine.
Figure 9:
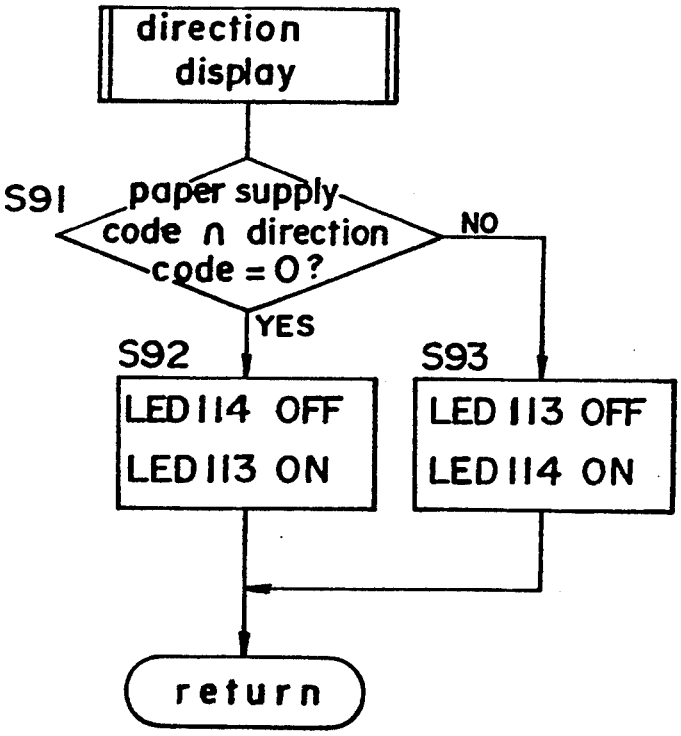
FIG. 9 is a flow chart showing the direction display routine within the paper inlet selection routine.

The paper inlet selection routine executed when the paper size selection keys 101 through 104 are depressed is described below with reference to FIGS. 7, 8 and 9.

Figure 7:
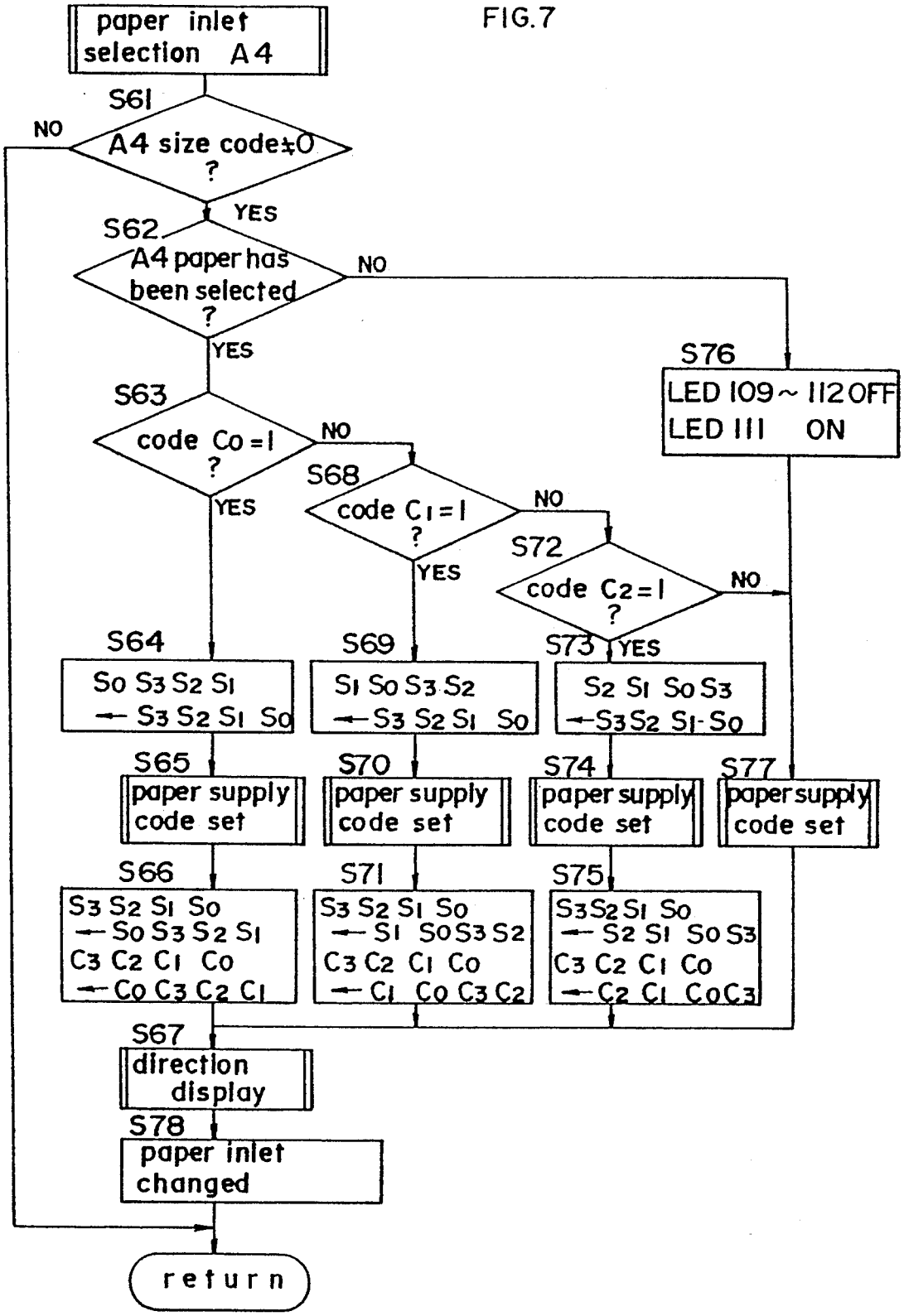
FIG. 7 is a flow chart describing the paper inlet selection routine within the paper select routine.

FIG. 7 uses an example wherein A4 size paper is selected, and shows the routine for selecting a paper inlet in which is loaded paper of a desired size when the selection key corresponding to said desired size is depressed. In the paper inlet selection routine, a selected paper inlet is specified by 4-bit codes $C_0$~$C_3$ corresponding to the paper inlets 20 through 23, as shown in Table 3. (These codes are referred to as "paper supply codes" hereinafter.)

When the A4 size paper size selection key 103 is depressed, first, a check is made to determine whether or not all of the bits $S3_0$~$S3_3$ of the A4 size code are set at value other than 0 (zero) (step S61). If all the bits $S3_0$~$S3_3$ of the A4 size code are set at 0 (zero), it indicates there is no A4 size paper present in any of the paper inlets, and the routine ends. If at least one of the bits $S3_0$~$S3_3$ of the A4 size code is set at 1, the routine advances to step S62. In step S62, a check is made to determine whether or not the A4 size paper had been selected prior to the actuation of the key 103. If A4 size paper was not selected prior to the actuation of the key 103, the selection display changes to display A4 by extinguishing all the selection display LEDs 109~112, and lighting the LED 111 (step S76).

On the other hand, if A4 size paper was selected prior to the actuation of the key 103, a check is then made to determine which paper inlet was selected. At this time, the LED 111 already has been lighted. First, a check is made to determine whether or not the paper supply code bit $C_0$ is 1, i.e., whether or not the paper inlet 20 is selected (step S63). If the reply to the query of step S63 is YES, the routine advances to step S64 (described later). If the reply to the query of step S63 is NO, a check is subsequently made to determine whether or not the paper supply code bit $C_1$ is 1, i.e., whether or not the paper inlet 21 has been selected (step S68). If the reply to the query of step S68 is YES, the routine advances to step S69, whereas if the reply is NO, a check is subsequently made to determine whether or not the paper supply code bit $C_2$ is 1, i.e., whether or not the paper inlet 22 has been selected (step S72). If the reply to the query of step S72 is YES, the routine continues to step S73. If the reply to the query of step S72 is NO, it is checked that cassette 23 has been selected prior to the actuation of the key 103.

The process for setting the paper supply code when the paper inlet accommodating A4 size paper is selected is described hereinafter using step S77 as an example. As shown in FIG. 8, a check is made to determine whether or not any of the code bits among the A4 size code bits $S3_0 \sim S3_3$ are set at 1. The determination at this time is performed sequentially for the paper inlets 20, 21, 22, and 23, i.e., for code bits $S3_0$, $S3_1$, $S3_2$, and $S3_3$. Accordingly, even when paper of the same size is present in more than one paper inlet, the paper of the previously selected paper inlet is selected from among said plurality of inlets.

First, if the $S3_0$ bit in the A4 size code is set at 1, the paper supply code is changed to 0001 to select the paper inlet 20 (step S82), and this routine ends. If the bit $S3_0$ is not set at 1, a check then is made to determine whether or not the bit $S3_1$ is set at 1 (step S83). If the S3, bit is set at 1, the paper supply code is changed to 0010 to select the paper inlet 21 (step S84), and this routine ends. If the bit $S3_1$ is not set at 1, a check then is made to determine whether or not the bit $S3_2$ is set at 1 (step S85). If the $S3_2$ bit is set at 1, the paper supply code is changed to 0100 to select the paper inlet 22 (step S86), and this routine ends. If the bit $S3_2$ is not set at 1, it is determined that the A4 size accommodating paper inlet is paper inlet 23, and the paper supply code is changed to 1000 (step S87), and this routine ends. The preceding description pertains to the routine for selection of a paper inlet accommodating a desired paper size and the setting of the paper supply code.

When a paper size is selected which is not the same as the paper size selected prior to the actuation of the paper size selection key, the paper inlets are determined sequentially from paper inlet 20. However, when a paper size is selected which is the same as the paper size selected prior to the actuation of the paper size selection key, the selected paper inlet may accommodate the same size paper but said paper may not provide the desired paper feed direction. Therefore, the paper inlet determining priority sequence must be changed beforehand so as to determine the selected paper inlet last and not select the same paper inlet again. In the present embodiment, the value set for each bit of the size code is substituted temporarily during the determination time only, thereby effectively changing the determination priority sequence for each bit. More specifically, in steps S64, S69, and S73, the value set for each bit $S3_3$, $S3_2$, $S3_1$, $S3_0$ of the A4 size code can be substituted so that the value for the bit of the selected paper inlet is determined lastly. Thus, in steps S65, S70 and S74, the same routine is executed as in step 77 to select the paper inlet and set the paper supply code. After completing the aforesaid steps, the value of each replaced bit of the A4 size code is rearranged to correspond to the original bits $S3_3$, $S3_2$, $S3_1$, $S3_0$ in steps S64, S69, and S73, and value of each bit of the paper supply code is also rearranged to $C_3$, $C_2$, $C_1$, $C_0$ (steps S66, S71, S75). This procedure sets the currently selected paper inlet with the proper paper supply code.

Step S67 is used to execute the LED display based on the direction code generated by the routine for generating code for each paper feed direction. FIG. 9 shows a flow chart for the direction display routine. First, as previously described, a check is made to determine whether or not the intersection of the set paper supply code and the direction code is 0 (zero) (step S91). If the intersection is 0, the selected paper inlet accommodates vertical feed paper, the LED 113 indicating vertical feed paper is lighted, the LED 114 indicating horizontal feed paper is extinguished (step S92), and this routine ends. Conversely, if the exchange value is 1, the selected paper inlet accommodates horizontal feed paper, the LED 114 is lighted and the LED 113 is extinguished (step S93), and this routine ends. Finally, a paper inlet switch is executed based on the aforesaid paper supply codes (step S78), and all the paper supply selection routines end.

The operation of each section is controlled in the paper selection routine (step S3) using all of the previously described routines, by determining from the size code what size paper is accommodated in which paper inlet, determining from the direction code whether the feed direction of the paper accommodated in the respective paper inlets is vertical or horizontal, and determining from the paper supply code which inlet is the currently selected paper inlet. Furthermore, the LEDs on the operation panel are controlled, and more specifically the LEDs indicating paper presence, and LEDs indicating the size and feed direction of the currently selected paper are controlled.

Although, in the present embodiment, the paper type, other than paper size, has been described as limited to the paper feed direction (vertical or horizontal feed directions), it is to be noted that the paper type discussed in the present invention is not limited to the feed direction and may be applied, for example, to various additional paper types such as paper color, quality and the like, such that said additional paper types may be included by adding only detection means and display means without increasing the number of keys on the operation panel. Furthermore, although selection keys have been provided for each paper size, it is understood that selection keys may be provided for each paper type such as color and quality and the like, and that various paper sizes may be selected by rotation with each depression of said keys. For example, when a key is provided for each color, the paper size and quality may be selected in rotation by each depression of said keys. The rotation selection method may be applied not only to paper size, but also paper types not provided with selection keys.

Although the present embodiment has been described in terms of a copying apparatus, it is understood that the present invention may be applied to various types of image forming apparatus provided with a plurality of paper inlets. Furthermore, the sheets employed for the image formation process are not limited to the paper type.

TABLE 1

| | Inlet 23 | Inlet 22 | Inlet 21 | Inlet 20 |
|---|---|---|---|---|
| A3 size code | $S1_3$ | $S1_2$ | $S1_1$ | $S1_0$ |
| B4 size code | $S2_3$ | $S2_2$ | $S2_1$ | $S2_0$ |
| A4 size code | $S3_3$ | $S3_2$ | $S3_1$ | $S3_0$ |
| B5 size code | $S4_3$ | $S4_2$ | $S4_1$ | $S4_0$ |

TABLE 2

| | Inlet 23 | Inlet 22 | Inlet 21 | Inlet 20 |
|---|---|---|---|---|
| Direction code | $T_3$ | $T_2$ | $T_1$ | $T_0$ |

TABLE 3

| | Inlet 23 | Inlet 22 | Inlet 21 | Inlet 20 |
|---|---|---|---|---|
| Paper supply code | $C_3$ | $C_2$ | $C_1$ | $C_0$ |

Furthermore, the present invention may be applied not only to paper selection but also to magnification selection.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a plurality of sheet supply inlets respectively accommodating different kinds of sheets;

selecting means for selecting a desired kind of sheets;

determining means for determining whether the presently selected sheets are the same kind as the sheets which have been selected prior to operation of the selecting means; and control means for controlling so that the sheet supply inlet accommodating the same kind of sheets as the sheet selected prior to operation of the selecting means but different from the sheet supply inlet used for sheet supply prior to operation of the selecting means is selected when the presently selected sheets are the same kind as the sheets which have been selected prior to the operation of the selecting means.

2. An image forming apparatus as claimed in claim 1 wherein said plurality of sheet supply inlets respectively accommodate different sizes of sheets.

3. An image forming apparatus as claimed in claim 2 wherein said control means controls so that the sheet supply inlet accommodating the same size of sheets as the sheet selected prior to operation of the selecting means and feeding the sheets in a different direction from the sheet supply inlet used for sheet supply prior to operation of the selecting means is selected.

4. An image forming apparatus comprising:

a plurality of sheet supply inlets respectively accommodating various sizes of sheets;

selecting means for selecting a desired size of sheets;

judging means for judging whether there are the sheet supply inlets accommodating the same size of sheets but feeding the sheets in a different direction;

determining means for determining whether the presently selected sheets have the same size as the sheets which have been selected prior to operation of the selecting means; and control means for controlling so that the sheet supply inlet accommodating the same size of sheets as the sheets which have been selected prior to operation of the selecting means and feeding the sheets in the different direction from the sheet supply inlet used for sheet supply prior to operation of the selecting means is selected when the presently selected sheets have the same size as the sheets which have been selected prior to the operation of the selecting means.

5. A method performed in an image forming apparatus comprising the steps of:

providing a plurality of categories for image forming and a plurality of sub-categories each of which further classifies each of the categories:

selecting one desired category;

determining whether the presently selected category is the same as the previously selected category; and causing the sub-category corresponding to the presently selected category and having the highest possibility for selection to be selected when the presently selected category is the same as the previously selected category.

6. A method as claimed in claim 5 wherein said sub-category having the highest possibility for selection is different from the sub-category selected upon the previous selection of the category.

7. An image forming apparatus which is operated in one of a plurality of category for image forming and one of a plurality of sub-categories each of which further classifies each the categories, said image forming apparatus comprising:

selecting means for selecting one desired category; and control means for controlling said selecting means so as to select one desired sub-category following the selection of the desired category.

8. An image forming apparatus as claimed in claim 7 wherein said categories include the size of sheets to be copied, and said sub-categories include sheet feeding directions.

* * * * *